United States Patent [19]

Frost

[11] 4,188,760

[45] Feb. 19, 1980

[54] MASONRY BUILDING BLOCK AND METHOD FOR FORMING SUCH A BLOCK

[76] Inventor: John L. Frost, 1454 Scrope Rd., Rydal, Pa. 19046

[21] Appl. No.: 917,376

[22] Filed: Jun. 20, 1978

[51] Int. Cl.[2] ..... E04B 2/00

[52] U.S. Cl. ..... 52/405; 52/612; 52/809

[58] Field of Search ..... 52/309.12, 405, 612, 52/809, 585

[56] References Cited

U.S. PATENT DOCUMENTS

| | | | |
|---|---|---|---|
| 3,295,278 | 1/1967 | Muhm | 52/309.12 |
| 3,318,062 | 5/1967 | Grants | 52/309.12 |
| 3,438,161 | 4/1969 | Koch | 52/309.12 |
| 3,936,987 | 2/1976 | Calvin | 52/585 |
| 3,982,369 | 9/1976 | Keleske | 52/612 |
| 4,075,380 | 2/1978 | Moens | 52/809 |

*Primary Examiner*—James L. Ridgill, Jr.
*Attorney, Agent, or Firm*—John W. Logan, Jr.

[57] ABSTRACT

An insulated masonry building block and a method for forming such a block in which cementitious aggregate material is cast around an insert formed from insulating material, whereby the insert remains a part of the block.

3 Claims, 2 Drawing Figures

MASONRY BUILDING BLOCK AND METHOD FOR FORMING SUCH A BLOCK

BACKGROUND OF THE INVENTION

The present invention relates, in general, to construction materials and, in particular, to an insulated masonry building block and a method of forming this block.

The demand for energy conservation has prompted many developments for improved thermal insulation of buildings. The better the insulation, the less loss to the outside of heat in the winter and coolness in the summer. The ultimate benefit is less consumption of oil, gas and electricity to heat or air condition the building.

Various approaches have been taken in the past to insulate building constructed with masonry materials. One technique, used in conjunction with different types of construction, involves applying layers of insulating material to the wall surfaces. Among the disadvantages of this approach is the loss of interior building space.

When using masonry building blocks, the recesses of the blocks have been fitted with inserts made from insulating material. In terms of efficient use of space, this approach has the distinct advantage of making use of space which might otherwise go unused.

A number of proposals have been developed previously by which the insulation is incorporated into the masonry building block. However, the result, generally, has been expensive in-place cost of the blocks. Some of these known techniques involve fitting, pouring or blowing insulating material into the block recesses at the building site, while in others the insulating material is fitted, poured or blown into the block recesses by the manufacturer of the block. Both of these approaches involve secondary operations after the blocks have been cast which add to the labor costs either at the building site or in the fabrication of the blocks.

Accordingly, it is an object of the present invention to provide a new and improved insulated masonry building block.

It is another object of the present invention to provide an insulated masonry building block which possesses the required load bearing capability and can be fabricated at a reasonable cost.

SUMMARY OF THE INVENTION

In accordance with the present invention, an insulated masonry building block is formed by providing an insert formed from insulating material and molding cementitious aggregate material around the insert. The insert serves two purposes. First, it is part of the hold which is used to form the masonry block. Second, it remains with the block as the insulation component. The benefits of the present invention will be clear. Given the need for the insulation component, the use of this component as part of the mold in the casting of the block eliminates the kinds of secondary operations which are currently required. Although the configurations of the inserts used by the present invention, in some instances, may be a bit more complex than those used at the present time, manufacturing techniques for fabricating these inserts are so well developed that the inserts may be made at relatively low cost. In addition, because the block is cast around the insert, the problem of fitting preformed inserts of a particular size into recesses in blocks which may vary dimensionally from block to block is eliminated. Finally, a masonry block formed in accordance with the present invention results in more intimate contact between the insulating material and the cementitious aggregate than with pefabricated inserts which are introduced after the block is cast.

DESCRIPTION OF THE DRAWING

Referring to the drawing.

DESCRIPTION OF PREFERRED EMBODIMENTS

Figure 1:
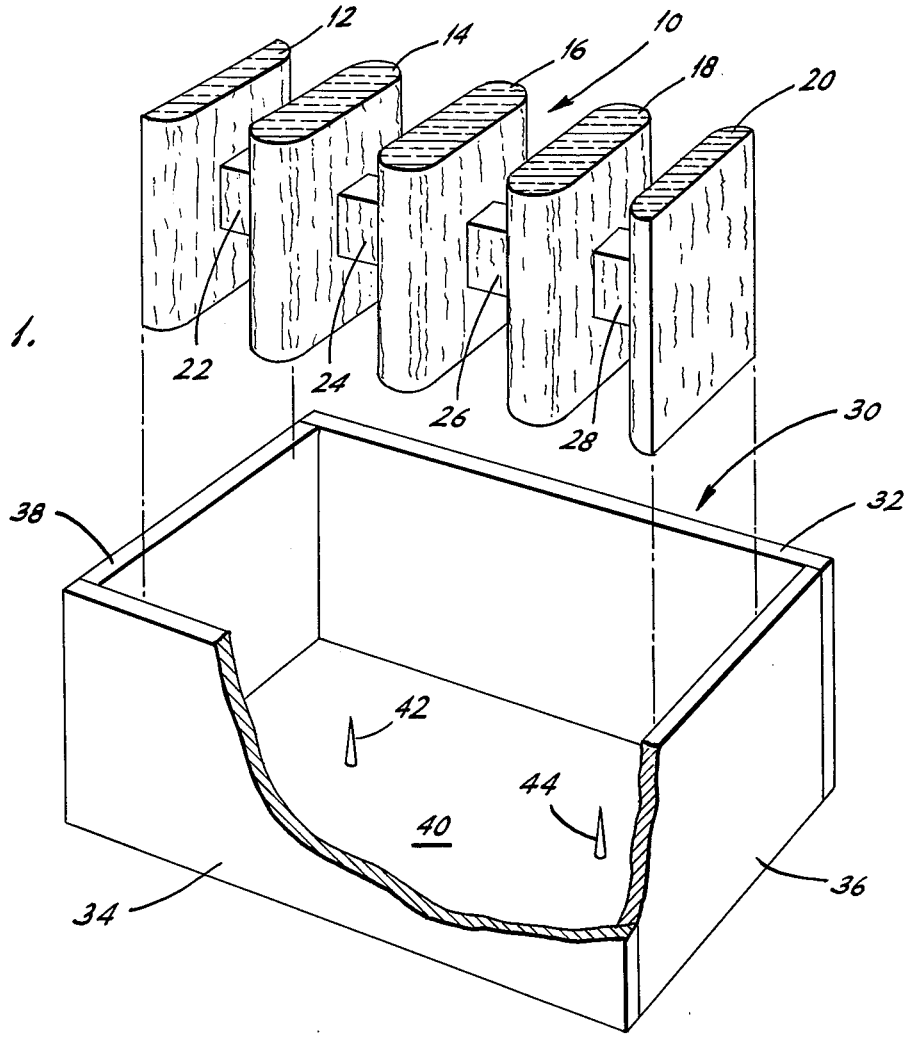
FIG. 1 is a perspective view of masonry block mold form and an insulating insert used in the present invention.

Referring to FIG. 1, an insert 10, made from insulating material, is seen to have a plurality of webs 12, 14, 16, 18 and 20. Intermediate webs 14, 16 and 18 are shaped and dimensioned complementary to the recesses in the masonry material portion of the building block being formed. End webs 12 and 20 are half the size of intermediate webs 14, 16 and 18, so that upon the matching up with another masonry block having a complementary end web, the two end webs together form the equivalent of an intermediate web.

Interconnecting the webs are a plurality of ribs 22, 24, 26 and 28. For the embodiment shown in the drawings, four ribs are used to interconnect five webs. These ribs serve two purposes. First, they facilitate handling of the insert in positioning the webs for the molding of the block. Second, the ribs contribute to the insulation feature of the block being formed.

Various other arrangements of webs and ribs are possible. For example, for a block which is to have only one intermediate web and two end webs, the three webs would interconnect by only two ribs. Also, one or more ribs may be eliminated, if desired, from an insert having a given number of webs in which case insert 10 is composed of two or more parts.

Various well known insulating materials, such as polyurethane and polystyrene, are available for the formation of insert 10 and various commonly used techniques may be employed to form the insert. If desired, the inserts may be formed from a combination of materials such as insulating material webs and metallic ribs.

Insert 10 is placed in a masonry block mold form 30 composed of side panels 32 and 34, end panels 36 and 38 and bottom panel 40. Panels 32, 34, 36, 38 and 40 are held together securely by suitable means.

Fixed to bottom panel 40 are a plurality of spikes 42 and 44 which serve to hold insert 10 securely in place when it is placed in mold 30. The nature of the material used in forming insert 10 is such that the spikes penetrate the insert as it is forced over the spikes. For the embodiment illustrated, two spikes are used and they penetrate the insert at the bottoms of webs 14 and 18. The number of spikes needed is dependent upon the size and nature of the block being cast and the size and nature of the insert.

With insert 10 properly located and held securely in mold form 30 by spikes 42 and 44, the mold form is filled with cementitious aggregate which flows around the insert as it is introduced into the mold form. After the cementitious aggregate has been allowed to set, the resultant block, with the insert intact, is removed from the mold form.

Figure 2:
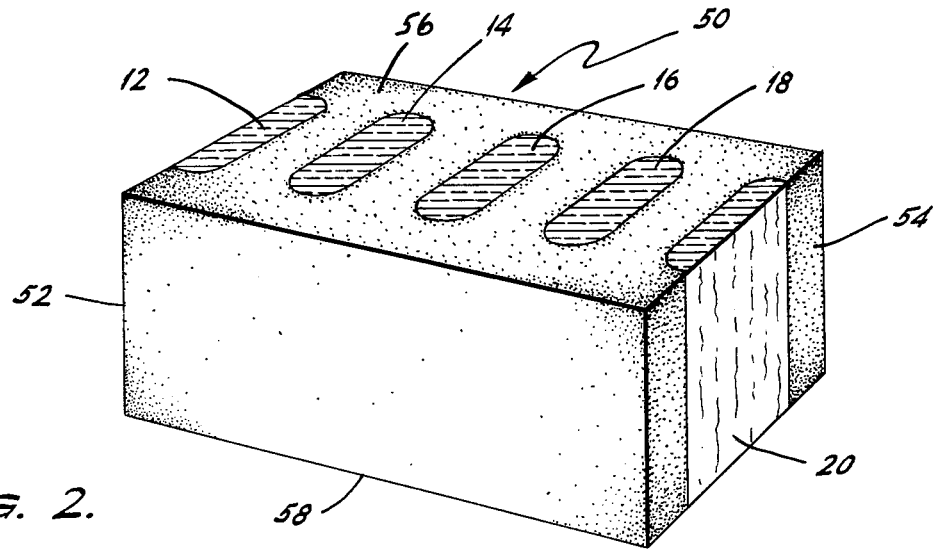
FIG. 2 is a perspective view of an insulated masonry block constructed in accordance with the present invention.

FIG. 2 shows the resultant masonry block 50. This block is composed of the cementitious aggregate material in the general form of a rectangular parallelepiped and the insert within the cementitious aggregate material. Webs 12, 14, 16, 18 and 20 run transverse of the block and parallel to end surfaces 52 and 54. The webs extend top-to-bottom of the block with the top and bottom surfaces of the webs being flush with the top and bottom surfaces 56 and 58, respectively, of the block. The outside surfaces of webs 12 and 20 are flush with end surfaces 52 and 54 of the block. The ribs of the insert (not seen in FIG. 2) run longitudinal of the block and parallel to the top and bottom surfaces of the block.

While the present invention has been described with reference to a preferred embodiment thereof, it will be understood by those skilled in the art that various changes and modifications may be made without departing from the true spirit and scope of the invention and it is intended that such changes and modifications will be covered by the appended claims.

I claim:

1. An insulating masonry building block in the form of a rectangular parallelpiped having end walls, side walls and top and bottom walls comprising:

an insert formed from insulating material, said insert including a plurality of web sections spaced uniformly apart longitudinally of the block, each web section extending vertically the full height of the block and extending horizontally to a point short of the side walls of the block, and said insert having rib portions of substantially lesser vertical and horizontal extent than said web sections extending longitudinally of the block connection each web section with the next adjacent web section at substantially its mid-point; and, cementitious aggregate material molded around said insert filling the rectangular parallelpiped shape of said block and in intimate contact with said insert.

2. An insulating masonry building block in accordance with claim 1 wherein the top and bottom surfaces of said web sections are exposed and flush with the top and bottom walls of the building block.

3. An insulating masonry building block in accordance with claim 1 wherein the outside surfaces of the two outermost web sections are exposed and flush with the end walls of said building block.

* * * * *